US005194065A

United States Patent [19]

Risko et al.

[11] Patent Number: 5,194,065

[45] Date of Patent: Mar. 16, 1993

[54] CARTON SQUARING MECHANISM

[75] Inventors: Frank D. Risko, Livonia; Barry C. Owen, Southfield, both of Mich.

[73] Assignee: Elopak Systems A.G., Glattbrugg, Switzerland

[21] Appl. No.: 806,623

[22] Filed: Dec. 13, 1991

[51] Int. Cl.[5] ..... B31B 1/74; B31B 1/78

[52] U.S. Cl. ..... 493/465; 493/310

[58] Field of Search ..... 493/309, 310, 318, 319, 493/465

[56] References Cited

U.S. PATENT DOCUMENTS

| | | | |
|---|---|---|---|
| 3,016,808 | 1/1962 | Galloway | 53/566 |
| 3,049,846 | 8/1962 | Jones | 53/579 |
| 3,421,416 | 1/1969 | Benzon-Petersen | 493/167 |
| 3,800,681 | 4/1974 | Corderoy | 493/167 |
| 3,888,164 | 6/1975 | Taddei | 493/316 |
| 4,029,001 | 6/1977 | Reichert | 493/319 |
| 4,571,236 | 2/1986 | Adams | 493/319 |
| 4,891,928 | 1/1990 | James et al. | 493/319 |
| 4,917,663 | 4/1990 | Pazdernik | 53/579 |
| 4,988,331 | 1/1991 | Boisseau | 493/171 |

*Primary Examiner*—William E. Terrell

*Attorney, Agent, or Firm*—Reising, Ethington, Barnard, Perry & Milton

[57] ABSTRACT

A carton squaring mechanism in a carrier for effectuating and maintaining a four-sided side-seamed open-topped carton in a squared configuration. The carrier includes a plurality of compartments, wherein adjacent compartments are separated by a pair of spaced-apart, laterally oriented, parallel fixed guides, a first off-center guide secured to one side of the carrier so as to be positioned closely adjacent to one of one pair of parallel guides and perpendicular to the planes of the latter. Each of the fixed guides has downwardly converging lower edges formed thereon for piloting the carton into the compartment. Each carton is first squared by engagement with oppositely disposed side rails, and then maintained square by the above referenced guides.

13 Claims, 3 Drawing Sheets

CARTON SQUARING MECHANISM

TECHNICAL FIELD

This invention relates generally to carton carriers on forming, filling and sealing machines and, more specifically, to a carton squaring mechanism for use on same.

BACKGROUND ART

While carton opening or erecting devices are well known for use on carton carriers, and some of these include devices for squaring and retaining cartons thereon, none are known to disclose thin longitudinal guides located in predetermined positions on four sides thereof and which serve to square an already opened carton while it is being lifted, as from one conveyor to a second conveyor.

Adams U.S. Pat. No. 4,571,236 discloses leading and trailing carton transport lugs on a conveyor chain, wherein the leading lug extends across the width of one side of an open-ended carton lying on a second side, at the center thereof. The leading lug is inclined approximately 5° rearwardly so as to engage the upper corner of the side to force the carton into a square attitude from a tendency toward a rhombic cross-sectional shape with the upper corner leading forward.

Taddei U.S. Pat. No. 3,888,164 discloses a conveying apparatus including two retaining members on separate chains serving to engage opposite sides of each container at opposite edges thereof after being removed from a magazine in a flat attitude by a suction cup.

DISCLOSURE OF THE INVENTION

A general object of the invention is to provide an improved carton squaring mechanism for a carton carrier.

Another object of the invention is to provide a carton squaring mechanism for cartons being lifted from one conveyor to a second conveyor.

A further object of the invention is to provide a carton squaring mechanism for open ended, four-sided cartons which have been opened from a flat blank condition, and which, even after one end thereof has been closed and sealed, tend to twist toward a rhombic shape, as the cartons are being lifted from one conveyor to a second conveyor, wherein the carton squaring mechanism includes vertical guides which force oppositely disposed extended corners of the rhombic shaped carton toward one another until a rectangular or square cross-sectional shape is attained by the carton.

These and other objects and advantages will become more apparent when reference is made to the following drawings and the accompanying description.

BEST MODE OF CARRYING OUT THE INVENTION

Figure 1:
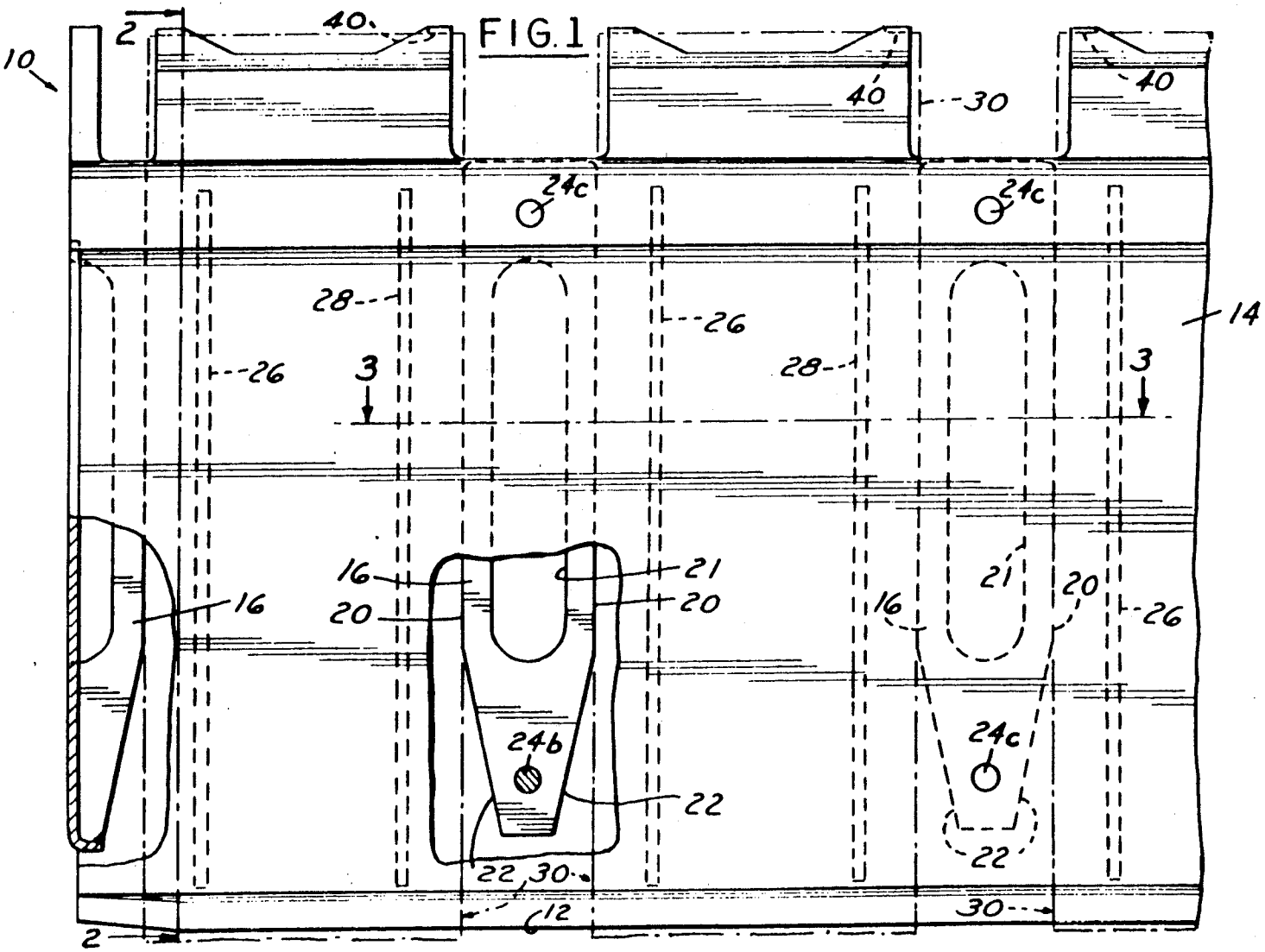
FIG. 1 is a fragmentary side elevational view of a plurality of carton carriers each adapted to receiving a carton as the latter is lifted from one conveyor to another, and embodying the invention.
Figure 2:
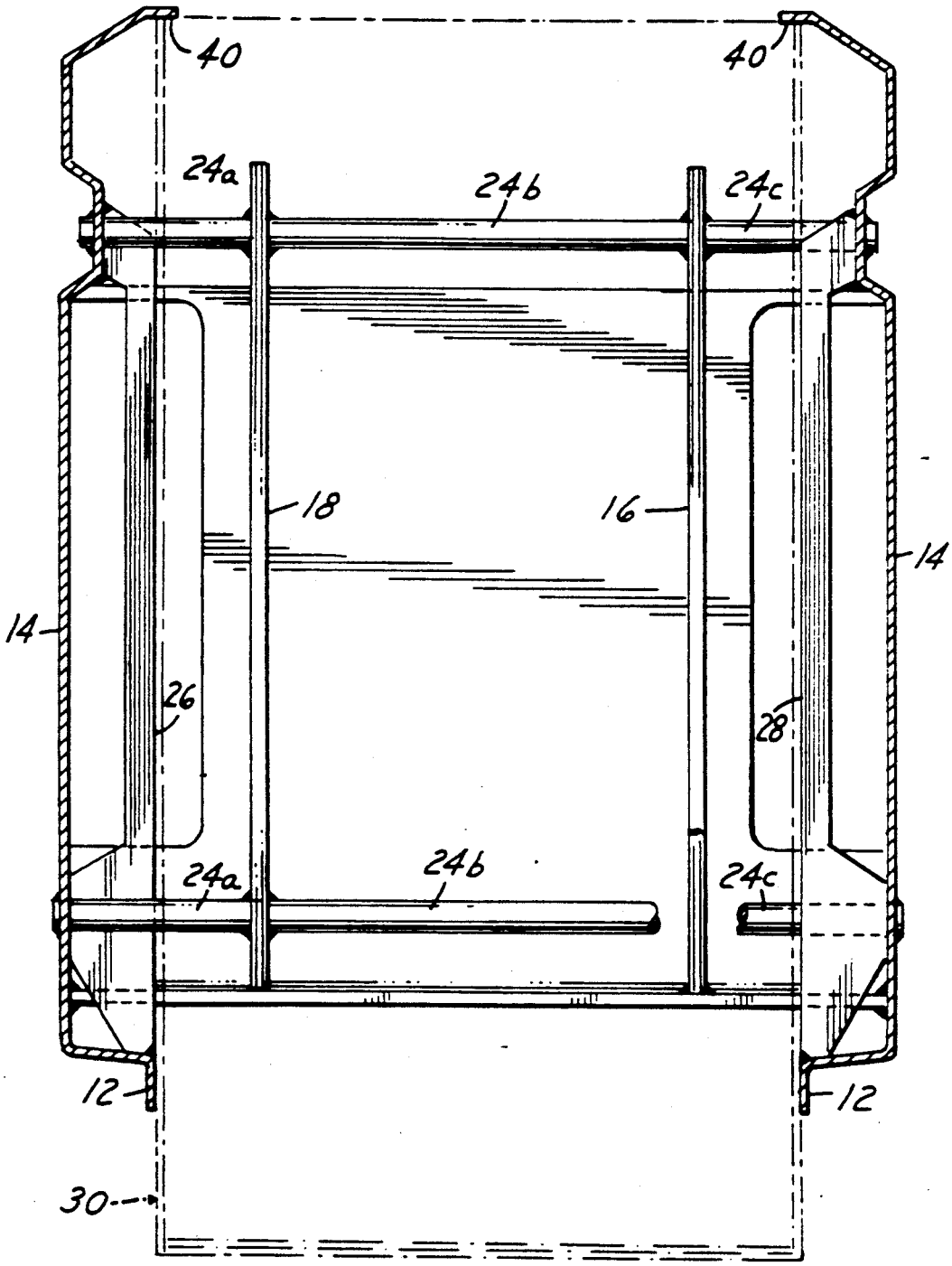
FIG. 2 is a cross-sectional view taken along the plane of the line 2—2 of FIG. 1, and looking in the direction of the arrows.
Figure 3:
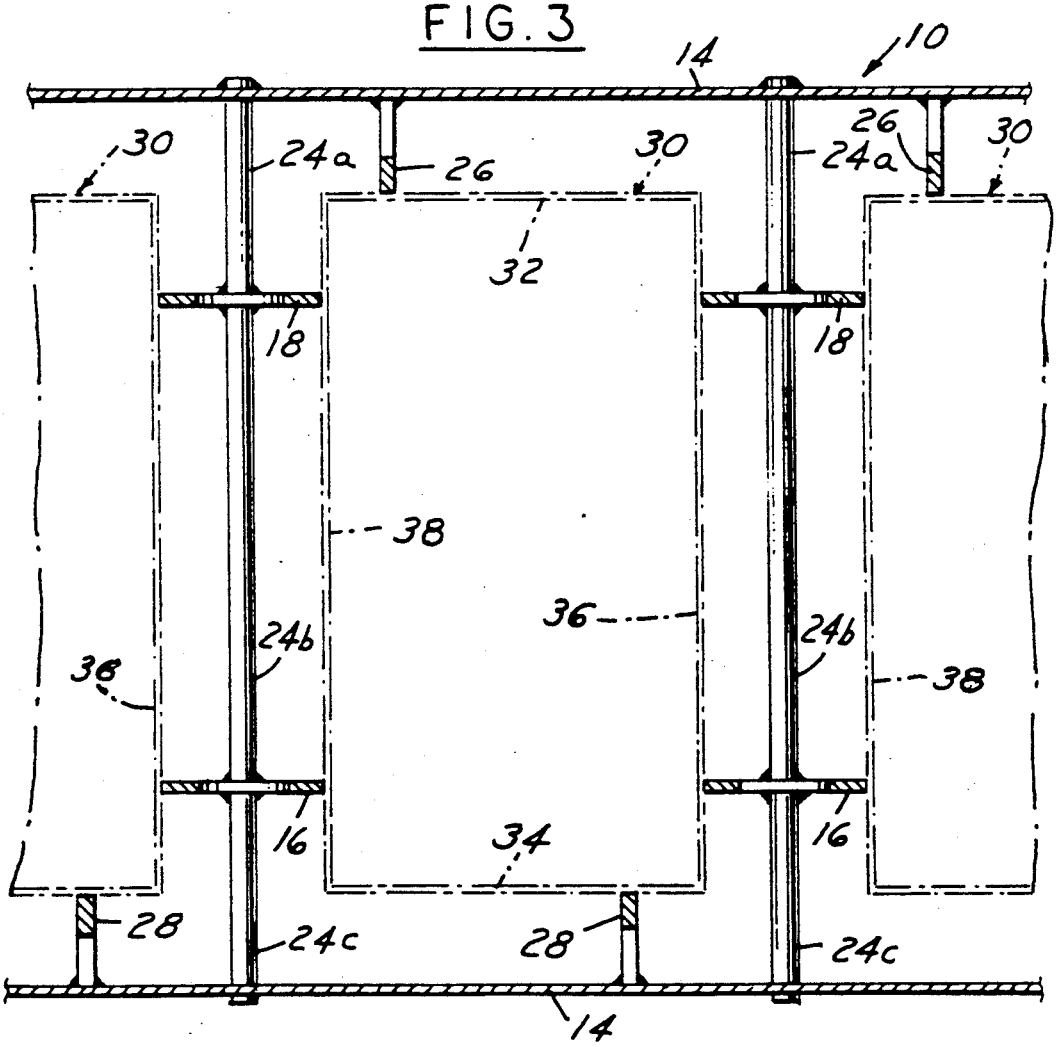
FIG. 3 is a cross-sectional view taken along the plane of the line 3—3 of FIG. 1, and looking in the direction of the arrows.

Referring now to the drawings in greater detail, FIGS. 1 to 3 illustrate a carton carrier apparatus 10, including a pair of oppositely disposed side rails 12 formed at the lower ends of a pair of side walls 14 (FIG. 2). Two pairs 16 and 18 of spaced-apart guides, each of which has oppositely disposed edges 20 (FIG. 1), are mounted at selected locations between the walls 14.

Each guide 16 and 18 is of a predetermined thickness and width. The width may have a portion 21 (FIG. 1) cutout of the center thereof to reduce its weight. Downwardly converging piloting edges 22 are formed at the lower end thereof.

Three aligned rod-like members **24*a*, 24*b* and 24*c* (FIG. 2) are secured respectively between one wall 14 and the adjacent side of the guide 18, between the other side of the guide 18 and the one side of the guide 16, and between the other side of the guide 16 and the other wall 14. As shown in FIG. 2, such three aligned rod-like members 24*a*, 24*b* and 24*c* are secured adjacent both the lower and upper ends of each of the spaced apart pairs of guides 16 and 18**.

As further shown in FIG. 2, an additional pair of guides 26 and 28, each having a thickness similar to that of the guides 16 and 18, are secured to the oppositely disposed walls 14 by any suitable means so as to extend perpendicularly therefrom. As shown in FIG. 3, the guides 26 and 28 are positioned such that they abut against locations adjacent diagonally oppositely disposed corners of any carton 30 being lifted therepast.

More specifically, oppositely disposed sides 32 and 34 of the carton 30 are first forced into a squared condition by the side rails 12 when the carton is indexed into the carrier 10. Upon being lifted into the carrier 10, the carton 30 will pass the rails 12 upwardly tending to resume the rhombic shape. By virtue of having to slide past the respective guides 26 and 28, the oppositely disposed sides 32 and 34 are again forced into a squared condition, while the other oppositely disposed sides 36 and 38 of the carton 30 are urged outwardly into an abutting relationship against the respective pairs of guides 16 and 18. As such, it is apparent that the carton is in a perfectly squared condition while being lifted upwardly, into engagement with pairs of stops 40 (FIG. 2) to maintain the location of the top of the carton 30.

Figure 4:
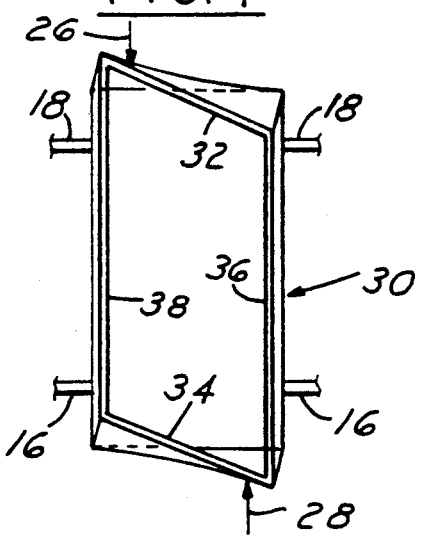
FIG. 4 is a top view of a carton which is processed by the invention, illustrating operational shapes to which the carton is subjected.

In other words, as a side-seamed blank, prior to opening into a tubular shape and having the bottom end thereof closed and sealed, the carton 30 had its side 32 lying against the side 38, and its side 34 lying against the side 36. Thereafter, there is a continuing tendency for the respective sides to return to this flat relationship, even after one end thereof has been closed and sealed. This tendency is illustrated in FIG. 4. It is apparent from FIGS. 2 and 4 that, as the carton 30 first enters the carrier 10, it is first squared by the side rails 12, prior to being lifted. This squaring condition is maintained by the off-center guides 26 and 28 (FIG. 3) which serve primarily to maintain the full height of the carton 30 in the squared configuration.

While in the open-topped, squared condition, an accurate aseptic application of an acceptable sterilization fluid, such as hydrogen peroxide, may be applied uniformly to the entire inside surface of each carton.

INDUSTRIAL APPLICABILITY

It should be apparent that the invention provides an efficient carton carrier apparatus for maintaining a carton in a squared condition for further processing.

It should be further apparent that while a carrier with four compartments has been shown and described, the carrier could comprise any selected number of compartments for other machine applications.

It should also be apparent that the carrier is adaptable to being sized to accommodate either square or rectangular cross-sectioned cartons.

While but one embodiment of the invention is shown and described, other modifications thereof are possible within the scope of the following claims.

The embodiments o the invention in which an exclusive property or privilege is claimed are defined as follows:

1. A carrier for receiving and maintaining a four-sided carton in a squared configuration, said carrier comprising a plurality of compartments each for receiving carton co-axially, each compartment comprising one said four-sided first and second spaced-apart guides provided on oppositely disposed sides of said compartment for bearing on respective external major faces of first and second opposite walls of said carton, characterized by a single off-center third guide provided on a third side of said compartment for bearing on an external major face of a third wall of said carton at a location adjacent to a first corner of the cross-section of said carton, and a single off-center fourth guide provided on a fourth side of said compartment for bearing on an external major face of a fourth wall of said carton at a location adjacent to a second corner of the cross-section of said carton diametrically opposite to said first corner.

2. The carrier described in claim 1, and a pair of oppositely disposed side rails formed at carton-entry ends of the respective third and fourth sides.

3. The carrier described in claim 1, wherein each of said guides has a tapered entry edge formed thereon for piloting a carton being received into said compartment.

4. The carrier described in claim 1, and further comprising a pair of stops formed a predetermined distance above each of said guides adapted to be engaged by a leading edge of said carton after being received within said guides.

5. The carrier described in claim 1, wherein said carrier includes four compartments.

6. The carrier described in claim 1, wherein said carton is received by being lifted through a bottom of said compartment and upwardly through said guides.

7. The carrier described in claim 1, wherein at least one of the first to fourth guides extends longitudinally of said carton.

8. The carrier described in claim 7, wherein said first to fourth guides are substantially parallel to each other.

9. The carrier described in claim 1, wherein the first to fourth guides are thin for thinly bearing on said carton.

10. The carrier described in claim 1, and further comprising fifth and sixth guides provided on said oppositely disposed sides of said compartment for also bearing on said respective external major faces of said first and second opposite walls of said carton, the first, second, fifth and sixth guides bearing on said first and second opposite walls adjacently to the respective four corners of the cross-section of the carton.

11. A carrier for axially receiving and maintaining a four-sided carton in a squared configuration, said carrier comprising a plurality of side-by-side compartments, each adapted to receive one carton, wherein adjacent compartments are separated by a pair of spaced-apart, laterally aligned, longitudinal fixed guides, each of said guides having downwardly converging lower edges formed thereon, and guides at each of the ends of the plurality of compartments being half the width of the guides intermediate adjacent compartments, a first off-center guide secured to a side wall of each said compartment so as to be positioned closely adjacent to one of a first pair of guides, a second off-center guide secured to an opposite side wall of each said compartment so as to be positioned closely adjacent to one of a second pair of guides, a pair of oppositely disposed side rails formed at lower ends of said respective side walls along the four compartments, and a pair of stops formed a predetermined distance above each of said first and second off-center guides adapted to be engaged by a top edge of said carton after being received within said guides.

12. A carrier for receiving a four-sided carton therein, said carrier including a plurality of compartments each having four sides for receiving one said four-sided carton, at least one said compartment being characterized by a plurality of thin longitudinally oriented guides provided on all of said four sides sides, at least one of said sides having a single off-center one of said guides, said guides being adapted to bear thinly on said carton to urge said carton into a squared configuration as it is longitudinally received in said compartment.

13. The carrier described in claim 12, wherein said guides include two pairs of guides provided on oppositely disposed sides of said one compartment, and single guides provided on each of the other oppositely disposed sides such that one single guide is positioned closely adjacent one pair of guides, and the other single guide is positioned closely adjacent the other pair of guides.

* * * * *

UNITED STATES PATENT AND TRADEMARK OFFICE

CERTIFICATE OF CORRECTION

PATENT NO. : 5,194,065

DATED : March 16, 1993

INVENTOR(S) : Frank D. Risko, et. al.

It is certified that error appears in the above-identified patent and that said Letters Patent is hereby corrected as shown below:

Column 3, Claim 1, line 4, between "ing" and "carton", insert --one said four-sided--.

Column 3, Claim 1, line 5, delete "one said four-sided".

Signed and Sealed this

Thirtieth Day of November, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,194,065

DATED : March 16, 1993

INVENTOR(S) : Frank D. Risko, Barry C. Owen, Howard E. Murrah, Robert M. Redding It is certified that error appears in the above-indentified patent and that said Letters Patent is hereby corrected as shown below:

On the title page: Item [75] add to INID Code as additional inventors: Howard E. Murrah, Fenton; Robert M. Redding, Brighton, both of Mich.

Signed and Sealed this

Twenty-eighth Day of December, 1993

*Attest:*

Bruce Lehman

BRUCE LEHMAN

*Attesting Officer*

*Commissioner of Patents and Trademarks*